US008686910B1

(12) United States Patent
Ives et al.

(10) Patent No.: US 8,686,910 B1
(45) Date of Patent: Apr. 1, 2014

(54) LOW REFLECTANCE RADIO FREQUENCY LOAD

(75) Inventors: R. Lawrence Ives, San Mateo, CA (US); Yosuke M. Mizuhara, Palo Alto, CA (US)

(73) Assignee: Calabazas Creek Research, Inc., San Mateo, CA (US)

( * ) Notice: Subject to any disclaimer, the term of this patent is extended or adjusted under 35 U.S.C. 154(b) by 763 days.

(21) Appl. No.: 12/758,614

(22) Filed: Apr. 12, 2010

(51) Int. Cl.
*H01Q 13/00* (2006.01)

(52) U.S. Cl.
USPC ..... 343/772; 343/771; 333/22 R; 333/22 F

(58) Field of Classification Search
USPC ..... 343/771, 772; 333/22 F, 22 R
See application file for complete search history.

(56) References Cited

U.S. PATENT DOCUMENTS

| | | | | |
|---|---|---|---|---|
| 3,508,277 | A * | 4/1970 | Barhtolomew et al. | 343/776 |
| 3,904,993 | A * | 9/1975 | James | 333/22 R |
| 4,061,991 | A | 12/1977 | Hamid et al. | |
| 4,271,361 | A | 6/1981 | Jacobs | |
| 4,593,259 | A * | 6/1986 | Fox et al. | 333/22 F |
| 4,658,261 | A * | 4/1987 | Reid et al. | 343/771 |
| 4,661,787 | A * | 4/1987 | Lang | 333/22 R |
| 4,711,983 | A | 12/1987 | Gerling | |
| 5,004,990 | A | 4/1991 | Bergero | |
| 5,311,200 | A * | 5/1994 | Walker et al. | 343/771 |
| 5,742,211 | A | 4/1998 | Lauf et al. | |
| 5,949,298 | A | 9/1999 | Ives | |
| 6,124,768 | A | 9/2000 | Makiyama | |
| 6,501,432 | B2 * | 12/2002 | Yuanzhu | 343/772 |
| 2007/0280605 | A1 | 12/2007 | Mendoza | |

OTHER PUBLICATIONS

Z.D. Farkas et al, High Power Disk Loaded Guide Load,Particle Accelerator Conference (PAC 05), May 16-20, 2005, Knoxville, TN, SLAC-PUB-11704.

* cited by examiner

*Primary Examiner* — Tho G Phan
(74) *Attorney, Agent, or Firm* — File-EE-Patents.com; Jay A. Chesavage

(57) ABSTRACT

A load for traveling microwave energy has an absorptive volume defined by cylindrical body enclosed by a first end cap and a second end cap. The first end cap has an aperture for the passage of an input waveguide with a rotating part that is coupled to a reflective mirror. The inner surfaces of the absorptive volume consist of a resistive material or are coated with a coating which absorbs a fraction of incident RF energy, and the remainder of the RF energy reflects. The angle of the reflector and end caps is selected such that reflected RF energy dissipates an increasing percentage of the remaining RF energy at each reflection, and the reflected RF energy which returns to the rotating mirror is directed to the back surface of the rotating reflector, and is not coupled to the input waveguide. Additionally, the reflector may have a surface which generates a more uniform power distribution function axially and laterally, to increase the power handling capability of the RF load. The input waveguide may be corrugated for HE11 mode input energy.

18 Claims, 8 Drawing Sheets

Load with reduced reflected input power

Reflection optics (axial proj)
1st & 2nd Reflection

Reflection optics (axial proj)
3rd & 4th Reflection

Reflection optics (axial proj)
5th and 6th Reflection

Reflection optics (axial proj)
1st & 2nd Reflection
308
306
304
302
Y
X

PDF at Reflector
402

Reflector Profile
404

Second Reflection Power Density
406
408

PDF at Reflector
502

Reflector Profile
504
505

Second Reflection Power Den
506
508

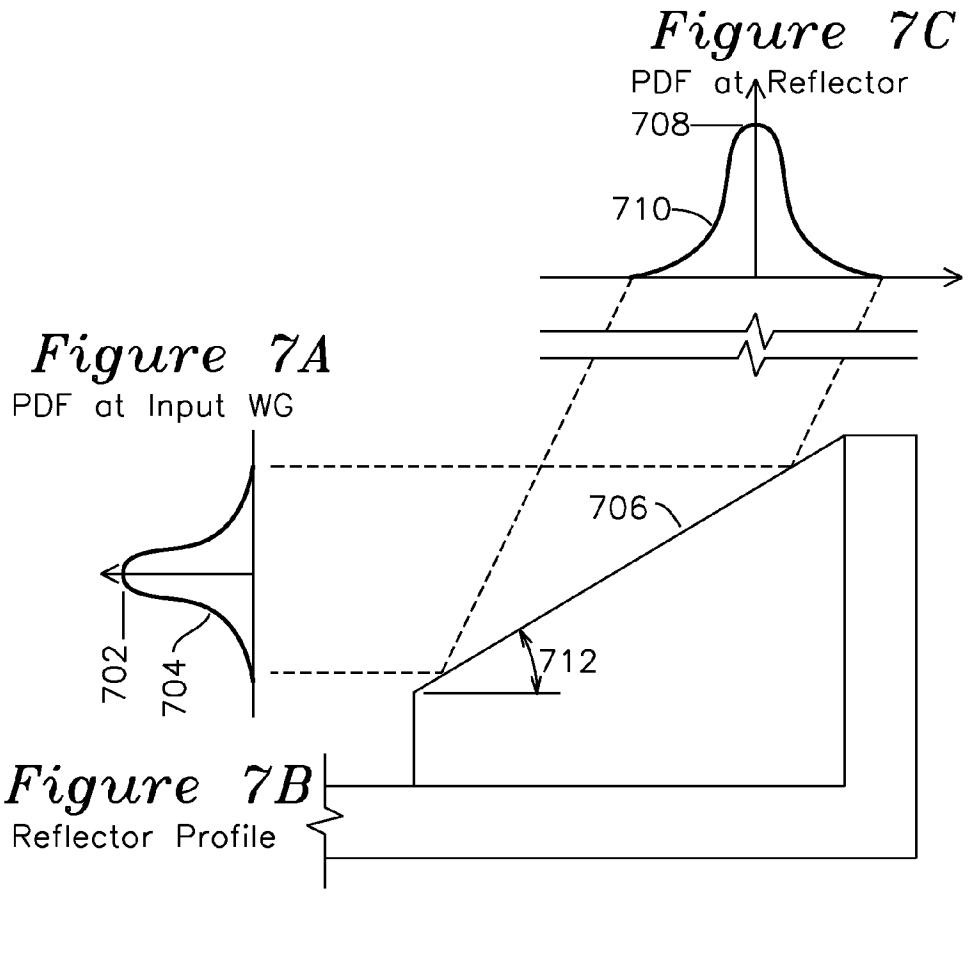
Figure 7C
PDF at Reflector
708
710
706
712
Figure 7A
PDF at Input WG
702
704
Figure 7B
Reflector Profile
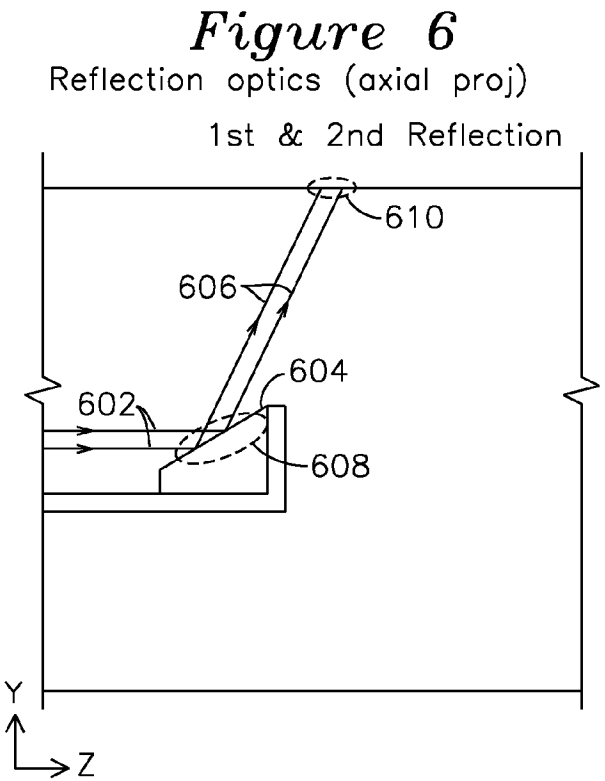
Figure 6
Reflection optics (axial proj)
1st & 2nd Reflection
610
604
608
606
602
Y
Z

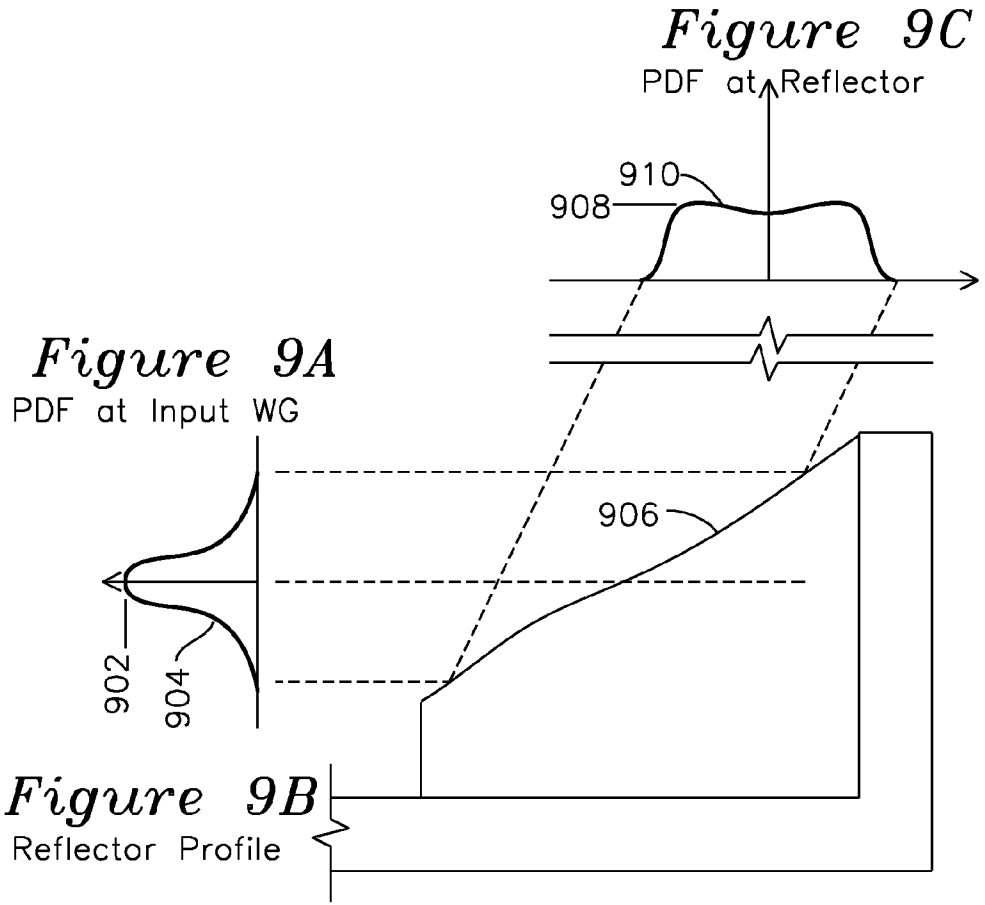
Figure 9C
PDF at Reflector
910
908
906
Figure 9A
PDF at Input WG
904
902
Figure 9B
Reflector Profile
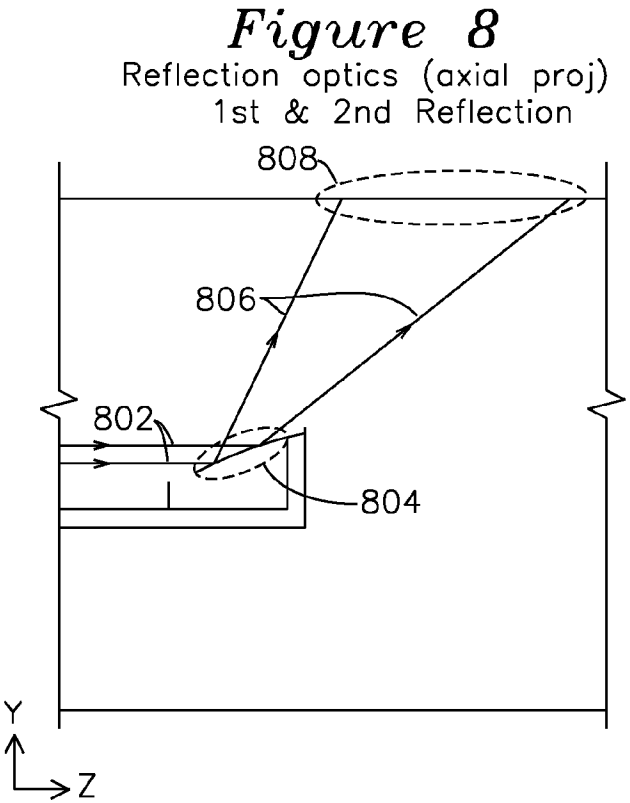
Figure 8
Reflection optics (axial proj)
1st & 2nd Reflection
808
806
804
802
Y
Z Rear-driven Load with reduced reflected input power

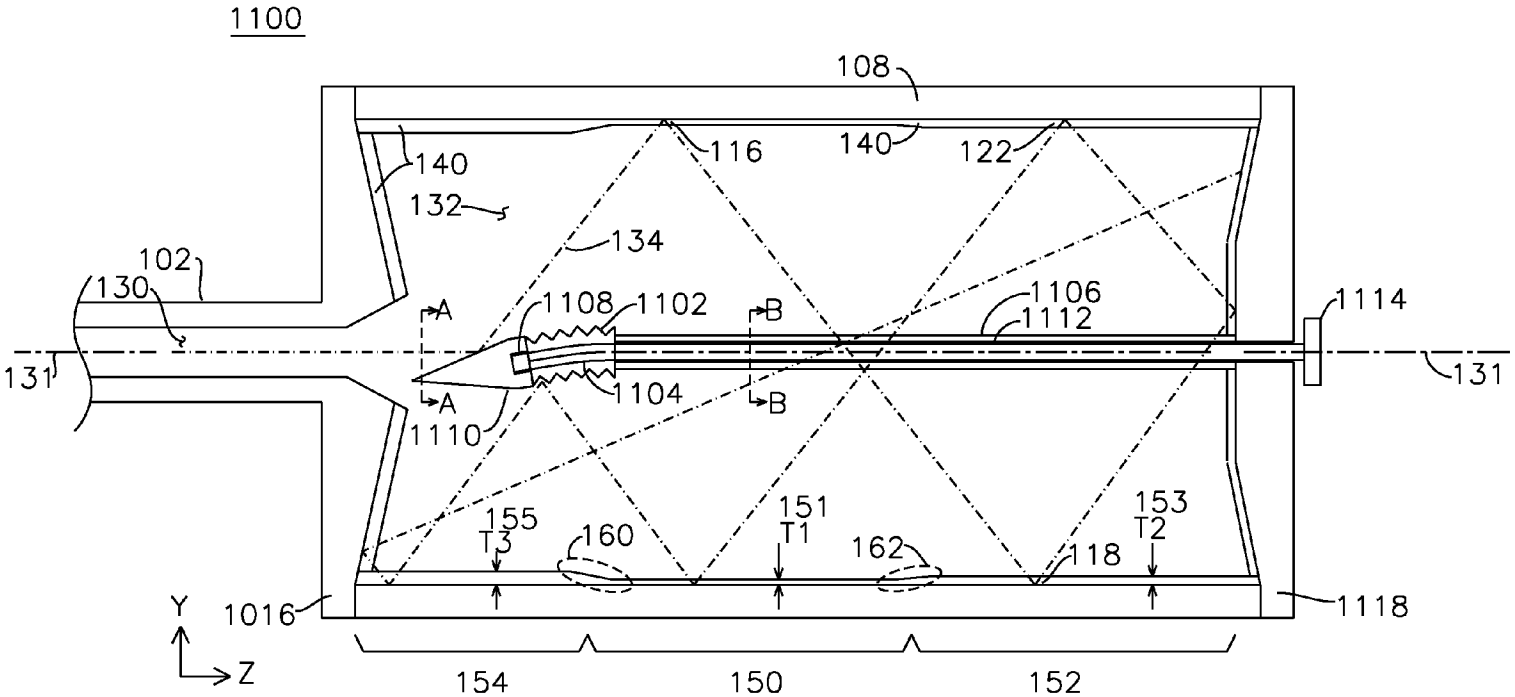
*Figure 11*
Reduced reflection load without rotary seals
*Figure 12A*
Section A–A
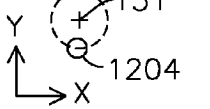
*Figure 12B*
Section B–B
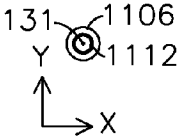

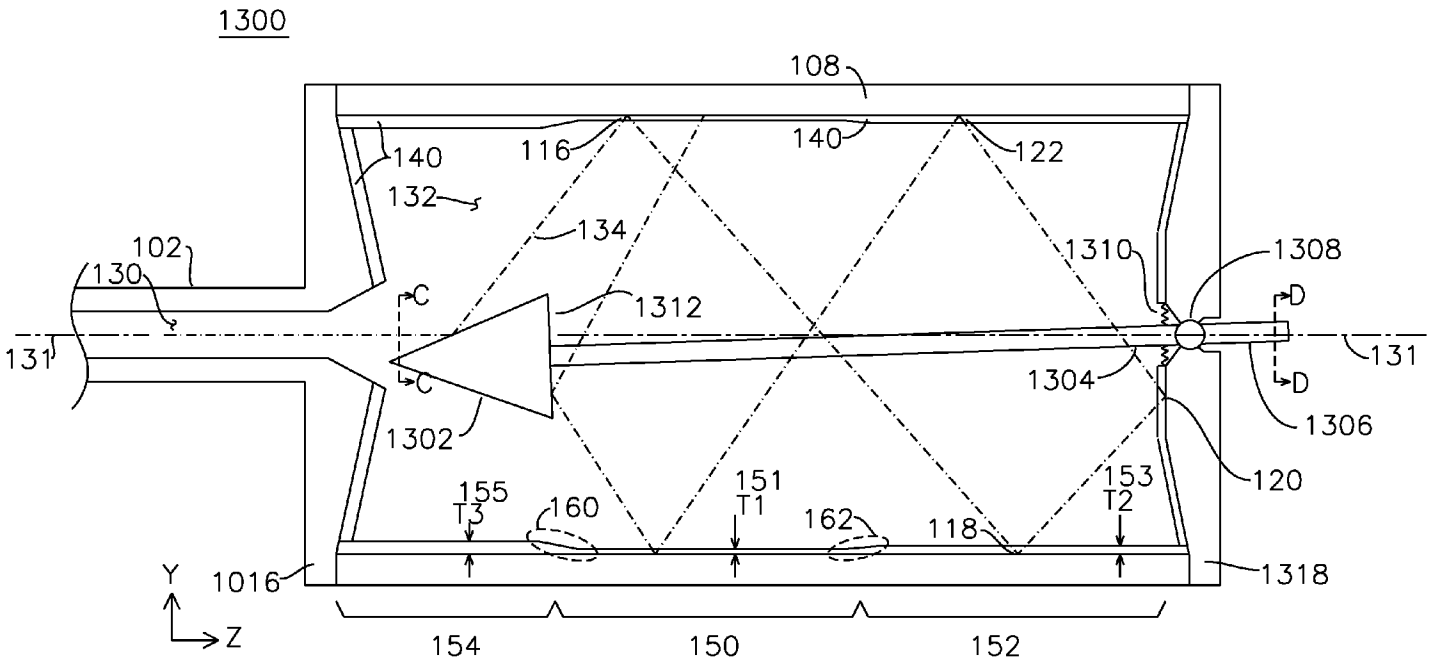
*Figure 13*
Reduced reflection load without rotary seals
*Figure 13A*
Section C–C
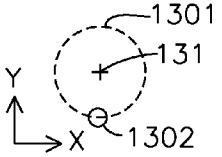
*Figure 13B*
Section D–D
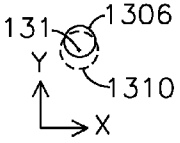

LOW REFLECTANCE RADIO FREQUENCY LOAD

The present invention was developed under the United States Department of Energy grant DE-SC0001930. The government has certain rights in this invention.

FIELD OF THE INVENTION

The present invention relates to a load for the termination of high power microwaves traveling through a waveguide or transmitted in a quasi-optical beam. In particular, the invention relates to a microwave load which minimally reflects applied power back to the input waveguide or RF source.

BACKGROUND OF THE INVENTION

A high power load coupled to an input waveguide must satisfy several operational requirements. One requirement is the uniform dissipation of a large input power which is presented through the input waveguide as a narrow and high energy density microwave beam. A second requirement is the reflection and distribution of input power in a manner which minimizes the formation of standing waves in the load, since standing waves can result in electric field enhancement and plasma arcing, which causes non-sustainable erosion of the load device. A third requirement is the minimization of reflected energy back to the input port.

Prior art microwave loads have attempted to trade off some of these requirements against other requirements. A prior art device capable of handling high input power density is described in U.S. Pat. No. 5,949,298 by Ives et al. In the device of Ives, RF power travels from an input waveguide into a cylindrical cavity to a far wall reflector, and the reflected power is subsequently directed against a plurality of dissipation surfaces. One difficulty of this prior art device is that some fraction of the input energy is reflected back to the input port. A computed and observed reflected power coupling of the prior art device of Ives shows 6% or more (−12 dB) of the applied power is reflected back to the input port. Because the input port of this device is exposed to a fraction of the reflected power in the cylindrical dissipation cavity, it is not possible to reduce the reflected input power below this level. A new microwave load device is desired which provides an additional reduction in the level of power reflected back to the input port. Additionally, the device of Ives is input power limited by the power density presented to the first reflection surface from the rotating reflector for certain traveling wave modes. For example, HE11 mode waves have a radial Gaussian energy profile with a "hot spot" at the center of the microwave beam which impinges on the coated interior wall, and removing heat from this beam profile with an elevated central power density limits the power handling capacity of the entire device, since power density of the central beam hot spot governs the temperature rise of the RF absorbing coating 140, and an RF absorptive coating such as black rutile is limited in operating temperature to less than 300° C. before damage to the coating occurs.

OBJECTS OF THE INVENTION

A first object of this invention is a load for high power microwave operation, the load having:

a cylindrical body positioned about a z-axis, the cylindrical body having an extent and forming a volume enclosed by a first end cap and a second end cap, the inner surfaces of the enclosed volume having a coating which reflects a fraction of impinging RF (radio frequency) and absorbs the remainder of the RF;

an input waveguide located on said z axis, said input waveguide having a stationary part and a rotating part;

a rotating reflector located in an extent between the first end cap and the second end cap, the rotating reflector coupled to the rotating part of the input waveguide, the rotating reflector coupling microwave energy from the input waveguide to an inner surface of the cylindrical body;

the RF absorbing coating of the cylindrical body inner surface having a comparatively small thickness over an extent of first inner surface reflection, a comparatively greater thickness over an extent of subsequent inner surface reflection over an extent from said small thickness extent to said second end cap, and a comparatively greater thickness over a terminal surface extent from the first end cap to the first inner surface extent.

A second object of the invention is a load which couples traveling wave energy from an input waveguide having a stationary part to a rotating part of the input waveguide, the rotating part passing through an aperture in a first end cap and coupling power to a rotating reflector and thereafter onto the inner surface of a cylindrical body, the opposite end of the cylindrical body closed by a second end cap, the cylindrical body inner surface having a terminal reflection extent which begins at the first end cap, a secondary reflection extent which begins at the second end cap, and a primary reflection extent between the terminal extent and secondary extent;

where power from the rotating reflector is directed to the primary reflection extent of the inner surface of the cylinder, the primary reflection extent having an inner dissipation surface coated with a microwave energy absorbing material, the reflected energy thereafter being directed to the secondary reflection extent of the cylindrical body, the reflected energy thereafter directed to the terminal extent and back surface of the rotating reflector which prevents coupling to the input waveguide.

SUMMARY OF THE INVENTION

The present invention is a load device for radio frequency (RF) traveling in a waveguide, the load having a first end cap, a second end cap, and a cylindrical body interposed therebetween. The inner surfaces of the end caps and cylindrical body have a surface coating which reflects part of the impinging RF and absorbs the remaining impinging RF, and the resulting thermal energy is removed with water passages located in the cylindrical body and end caps. The first end cap has an aperture for an input waveguide having a stationary part with an input port coupled to the source of microwave energy, and a rotating part of the input waveguide which is coupled through the first end cap to a rotating reflector. The rotating reflector redistributes the power density profile of the input RF beam and also re-directs microwave energy to the interior surfaces of the cylindrical body and end caps in a manner which dissipates the energy, minimizes the formation of standing waves, and has a reflection geometry which minimizes the reflected energy travelling back to the input port, such as by including a baffle on the opposite side of the rotating reflector which and selecting a reflector and inner surface geometry such that multi-path reflection impinge on the back surface of the reflector and are thereby prevented from entering the input waveguide. For a single mode input wave with a Gaussian profile, the rotating reflector may have a reflection surface which generates a uniform power density at a first reflection surface of the cylindrical body. The rotating reflector may also have an axial profile for spreading the input energy across an axial extent of the cylindrical body, and a different azimuthal profile for spreading the input energy circumferentially across the cylindrical inner surface.

BRIEF DESCRIPTION OF THE DRAWINGS

FIG. 6 is a diagram of a lateral section view in the YZ plane of a reflector and an inner wall.

FIG. 7A is a plot of the power distribution function for an input waveguide.

FIG. 7B is a diagram for an example linear reflector profile such as the one shown in FIG. 6.

FIG. 7C is a plot of the power distribution function at a reflector dissipation surface.

FIG. 8 is the diagram for a section view in the YZ plane of a reflector an inner wall.

FIG. 9A is a plot of the power distribution function for the power in a waveguide applied to a peak flattening reflector.

FIG. 9B shows a peak flattening reflector profile.

FIG. 9C is the plot of a power distribution function of a reflection from a peak-flattening reflector.

FIG. 11 shows a cross section view of a rear driven low reflection RF load without rotary seals.

FIGS. 12A and 12B show cross section views of FIG. 11.

FIG. 13 shows an example cross section view of a rear driven low reflection RF load without rotary seals.

FIGS. 13A and 13B show cross section views of FIG. 13.

DETAILED DESCRIPTION OF THE INVENTION

Figure 1:
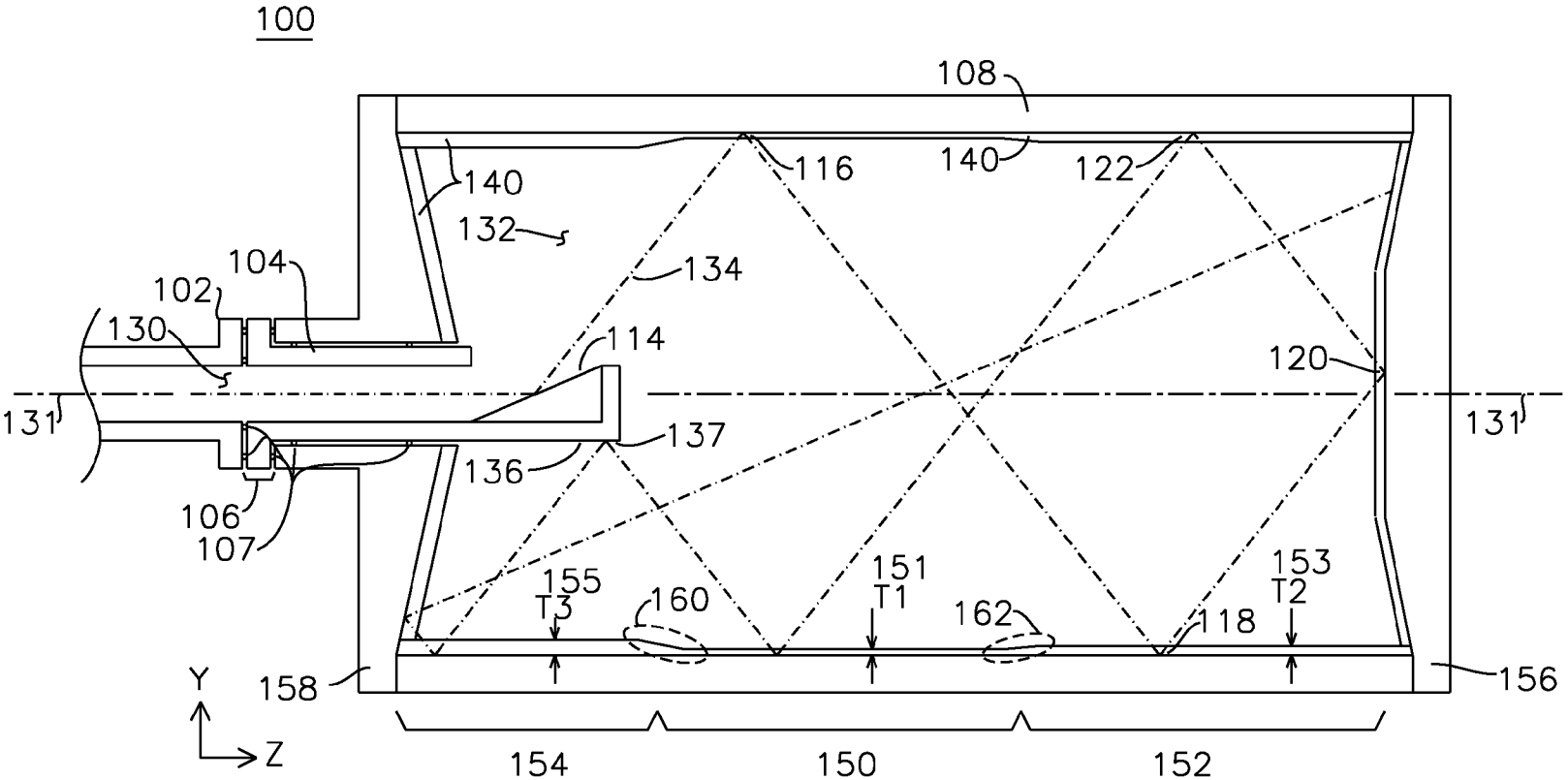
FIG. 1 shows a diagram of a lateral section view in the YZ plane for a microwave load according to the present invention.

FIG. 1 shows an example embodiment of the load device 100. Microwave traveling wave energy enters through input waveguide 130 through stationary waveguide 102 and rotating waveguide 104 which are electrically coupled and mechanically isolated through rotary waveguide joint 106 including optional seals and bearings 107 as is known in the prior art. The stationary and rotary waveguides 102, 104, and 106 may be of any construction suitable for the mode of the waves propagated. For the propagation of HE11 waves, a corrugated waveguide is commonly used, and other waveguide types are also possible which are commonly configured to preferentially propagate RF energy which travels in a particular wave mode. In the present example embodiment, the input waveguide is circularly symmetric about a central axis 131. RF energy which travels in the direction of an applied input power wave is referred to as "co-propagating", whereas reflected RF energy which follows the same trajectory but travels in the opposite direction is referred to as "counter-propagating", and this counter-propagating RF energy which traces a reflection path back to the input port becomes undesired reflected power, which is characterized by the scattering parameter S11. The input characteristic for power applied to the input port is characterized by the scattering parameter S21.

FIG. 1 shows the trajectory 134 (with center of beam shown as a dashed line) of input RF propagation path 134 which includes the first reflection from the surface of rotating reflector 114, second reflection 116 from cylindrical body 108, third reflection 118, fourth reflection 120, fifth reflection 122, etc. Rotating reflector 114 has a surface profile and angle selected such that the complete trajectory of the reflections ultimately reflect reflected energy 137 to the back surface 136 of the rotating reflector 114, which minimizes the amount of counter-propagating energy directed to the input waveguide 130, thereby minimizing reflected power. The power absorbed in the first reflection from the rotating reflector is minimized to reduce power dissipation in the rotating reflector, since the power density at the reflector is the highest in the device, and the power dissipation and reflected energy for the subsequent reflections from the cylindrical body are provided with a variable absorptive coating thickness which is selected to match the local power dissipation capability of the inner surface. The peak localized power dissipation for a particular region is related to the areal power density of the RF beam size. In one embodiment of the invention which uses absorptive coatings with thicknesses related to the objective of reducing power dissipated in the initial reflections, the inner surface of cylindrical body 108 is divided into three dissipation regions, a primary reflection region 150 where the incident power level is the highest and the incident beam size is the narrowest, resulting in the highest areal power density, a secondary reflection region 152 of subsequent reflection energy (a region which includes the inner surface of the second end cap 156), and a terminal reflection region 154 where the beam power is largely exhausted after dissipation in reflections in primary reflection extent 150 and secondary reflection extent 152. A coating of absorptive material such as black rutile or carbon is applied with a coating thickness selected according to the areal power density in each region. The method of application of the absorptive material may include sputter coating, plasma deposition or other means which results in a thermal bond to the underlying end caps 158, 156 or cylindrical body 108. The primary reflection region 150 has the highest areal power density, and a corresponding thinnest coating thickness, such as a coating thickness T1 151 which absorbs on the order of 30% (1.5 dB) of the incident RF power. The secondary reflection region 152 has a reduced areal power density compared to the primary region, and the coating thickness T2 153 is on the order of 50% (3 db) of the incident RF power, and the terminal reflection region 154 (which includes first end cap 158) has the highest RF power absorption of 80% (7 dB), and accordingly has the greatest coating thickness T3 155. Transition zones 160 and 162 taper the absorptive coating thickness between attenuation extents 154 to 150 and 150 to 152, respectively, to avoid enhancement of internal electric fields from discontinuous steps, and these transition zones should span many hundreds of wavelengths, but because of the process used to sputter coat the absorptive coating 140, the transition zone has an extent on the order of a hundred millimeters. The first end cap 158 and second end cap 156 may include regions of angled wall intersecting body 108 which tend to reflect the beam power away from the reflector 114 for minimization of reflected power to the input waveguide 130. Rotary waveguide 106 is typically coupled via gear or belt drive to a motor which causes rotation of the rotating waveguide 104 and attached reflector 114 at a rate on the order of 28 RPM, or any rate sufficient to prevent the excess buildup of thermal energy in absorptive coating 140 or cylindrical body 108.

The cylindrical body 108, first end cap 158 and second end cap 156 may be fabricated from any material with high thermal conductivity such as aluminum, and the rotating reflector 114 may be fabricated from any material with minimum reflective loss and high thermal conductivity, such as oxygen free copper. The rotating reflector 114, cylindrical body 108, first end cap 158 and second end cap 156 are all water cooled (not shown), and the rotary joint waveguide 106 may be a vacuum-tight joint such that the inner volume 132 can be evacuated of any gas which could interact with the high RF fields to form a plasma which may etch or erode the inner dissipation surface coatings. Optical viewing ports (not shown) may also be present for the detection of internal arcing, which is commonly used in conjunction with an interlock system which disables the microwave source.

Figure 2A:
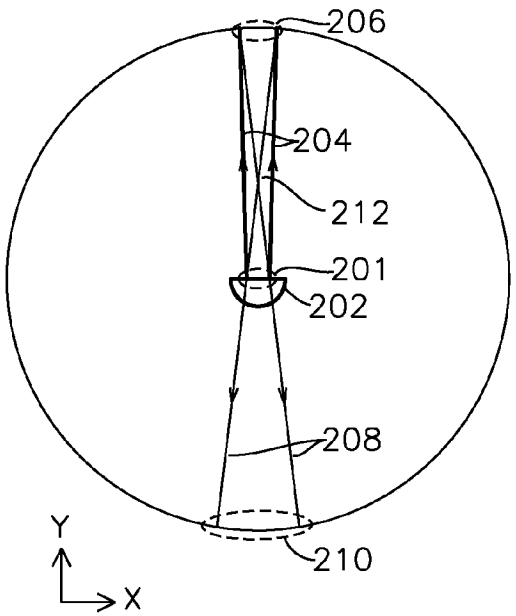
FIGS. 2A, 2B, 2C are axial projection views in the XY plane showing the lateral spreading of power over multiple reflections in the load of FIG. 1.
Figure 2B:
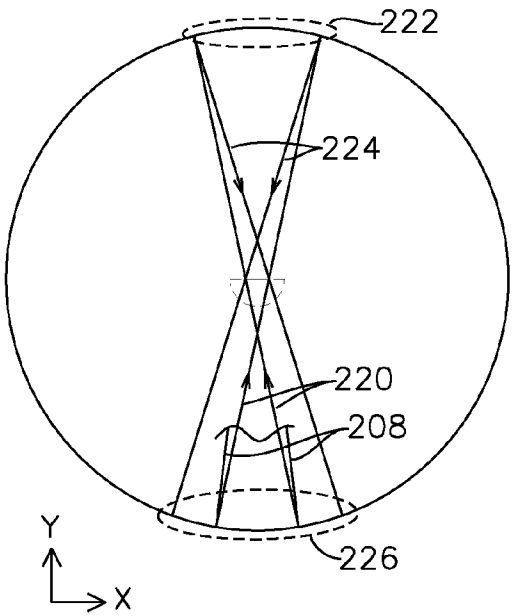
Figure 2C:
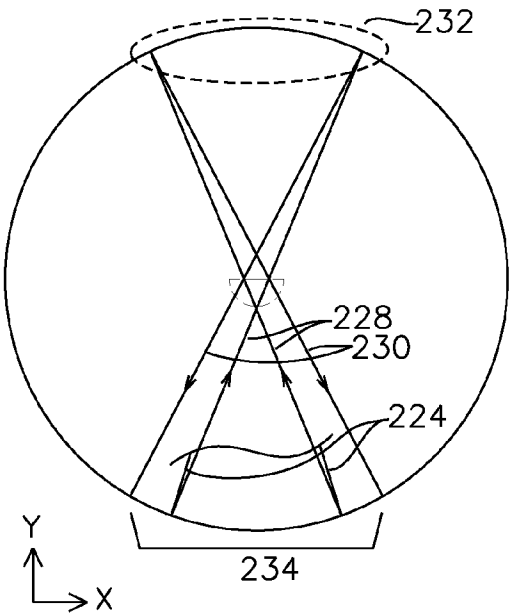
Figures 3, 4A, 4B, 4C, 5A, 5B, 5C:
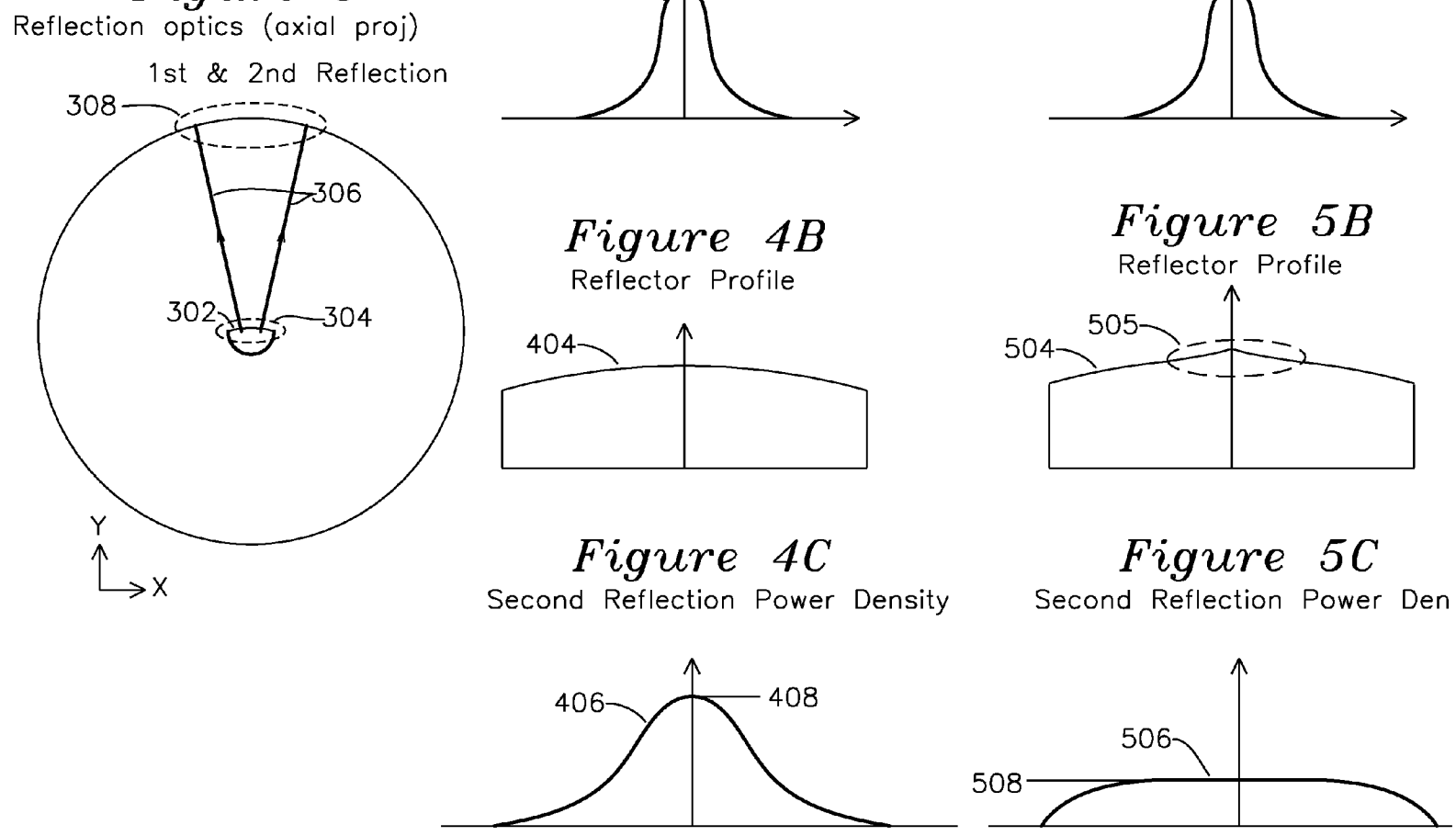
FIG. 3 is an axial section view in the XY plane showing a reflector and inner wall.
FIG. 4A is the plot for a power distribution function at the reflector.
FIG. 4B is a section view of an example reflector.
FIG. 4C is a plot of the reflected power density at the inner surface of the cylindrical body.
FIG. 5A is a plot of the power distribution function applied to a reflector.
FIG. 5B is a section view of an example reflector profile for a peak-flattened reflector.
FIG. 5C is a plot of the reflected power density for an example peak-flattened reflector at the inner surface of the cylindrical body.

FIG. 2A shows an axial projection of the example load of FIG. 1 for an example reflector 202 with a second reflection 206 and third reflection 210 (over different Z axis extents) and best understood in combination with FIG. 1. Incoming axial RF energy which reflects from the reflector 202 surface 201 such as reflector 114 of FIG. 1 is shown in ray-optic form with extent boundaries 204, where the power is reflected from the reflector 201 to primary reflection inner surface 206 through focal point 212 to a secondary reflection surface 210. FIG. 2B shows the subsequent reflected energy 220 from 208 which reflects from surface 222 with extents 224 and to reflection surface 226, and FIG. 2C shows the ray-optic incident extent 224 which is reflected from surface 232 to surface 234. One of the issues for a high power load is the tradeoff between removing a maximum amount of power at each reflection surface, in particular the first reflection surface 206 where the beam width is the narrowest and power density highest, while limiting the temperature increase of the dissipation surface 206. FIG. 3 shows one solution for reducing the power density at the cylindrical body first reflection 308, where the reflector surface 302 has a convex profile which spreads the input energy over a greater angular surface. FIG. 4A shows a plot of the power density function 402 of the RF applied to the input waveguide and directed to the reflector 302. An example convex reflector profile 404 (in cross section) is shown in FIG. 4B, and the resulting second reflection power density at the inner surface of the cylindrical body is shown as power density plot 406 with a peak areal power density at the center point 408. It is possible to form the reflector surface such that the peak 408 is reduced and the power uniformly spread over the same extent, such as by using the reflector profile shown in FIG. 5B with region 505 modified to redistribute the peak level over the same extent. The application of power of FIG. 5A plot 502 results in a more uniform power density, as shown in plot 506 of FIG. 5C with reduced peak 508.

FIG. 6 shows the geometry for the reflector in the YZ plane. Incoming RF power 602 is directed to flat reflector 604, which is shown in detail view 608 in FIG. 7B. Incident power distribution function plot 704 from the input waveguide is shown with peak power 702. Reflector 706 angle 712 is selected to ensure that minimal RF energy which reflects from first reflection surface 610 is directed back to reflector 604 and returning to the input waveguide, and this requirement for non-reflection to the reflector provides the constraint that angle 712 be less then 45 degrees, or less considering the beamwidth after first reflection. Conversely, angle 712 should be large enough to result in at least 3 reflections, preferably at least one reflection in each of the primary reflection extent, secondary reflection extent, and terminal reflection extent, which results in angle 712 being at least larger than 5-10 degrees. In the present example shown in the figures, angle 712 is 30 degrees and is selected to maximize the number of attenuative inner surface reflections and minimize the reflected power reflected to the input port, preferably instead directing reflected power to the baffled rear reflector surface which is isolated from coupling this power to the input waveguide.

FIG. 7A shows the power distribution function at the input waveguide and FIG. 7C shows the power distribution function at the second reflection surface 610 after reflection from surface 706.

FIG. 8 shows an alternate embodiment for the axial profile of the reflector surface 808, shown over extent 804 as modified reflector surface 906 in FIG. 9B. As was described for the axial section shown in FIG. 5B for reducing the peak power and generating a more uniform profile, the reflector surface 906 is shown as modified to create a more uniform power level over the axial extent 808 of the reflection surface. Waveguide power density is shown in plot 904 with a peak power level 902, and reflector surface 906 redistributes the power into the profile shown in plot 910 of FIG. 9C, with reduced peak 908 and a more uniform power distribution across the same extent.

The internal dissipation of RF energy across the inner surface of the load may be accomplished many different ways. In one example shown in FIG. 1, the dissipation surfaces have an absorptive coating which is applied such as by sputtering vapor of the RF absorptive coating material onto the inner surface which is chosen to be highly reflective for RF such as aluminum, copper, or a metallic plating which has high conductivity and a thickness which exceeds the skin depth of the impinging RF. Alternatively, in another embodiment, the cylindrical body and end caps may be fabricated from a material which exhibits a uniform dissipation upon reflection of the impinging wave, such as stainless steel. In this example embodiment, each inner reflection results in a constant dB loss with a skin depth on the order of hundreds of microns for frequencies in the hundreds of Ghz, and the cylindrical body axial length (and also optionally diameter) is increased to generate additional reflections over an extended axial extent, resulting in the same multipath attenuation before the returning energy strikes the back surface 136 of the reflector 114, compared to the increased attenuation and shorter multiple reflection path of absorptive coating 140 with thickness variations T1, T2, and T3 shown in FIG. 1.

The RF load is suitable for any modes or frequency of applied electromagnetic radiation which exhibits quasi-optical behavior, including the domains of traveling RF waves in space or in waveguides, and high power optical sources including lasers and the like.

Water cooling of the heat developed in the inner absorptive surfaces of the load device 100 of FIG. 1 may be achieved in any standard method by introducing water jackets into the structures of the cylindrical body 108, end caps 156, 158, and rotating reflector 114.

Figure 10:
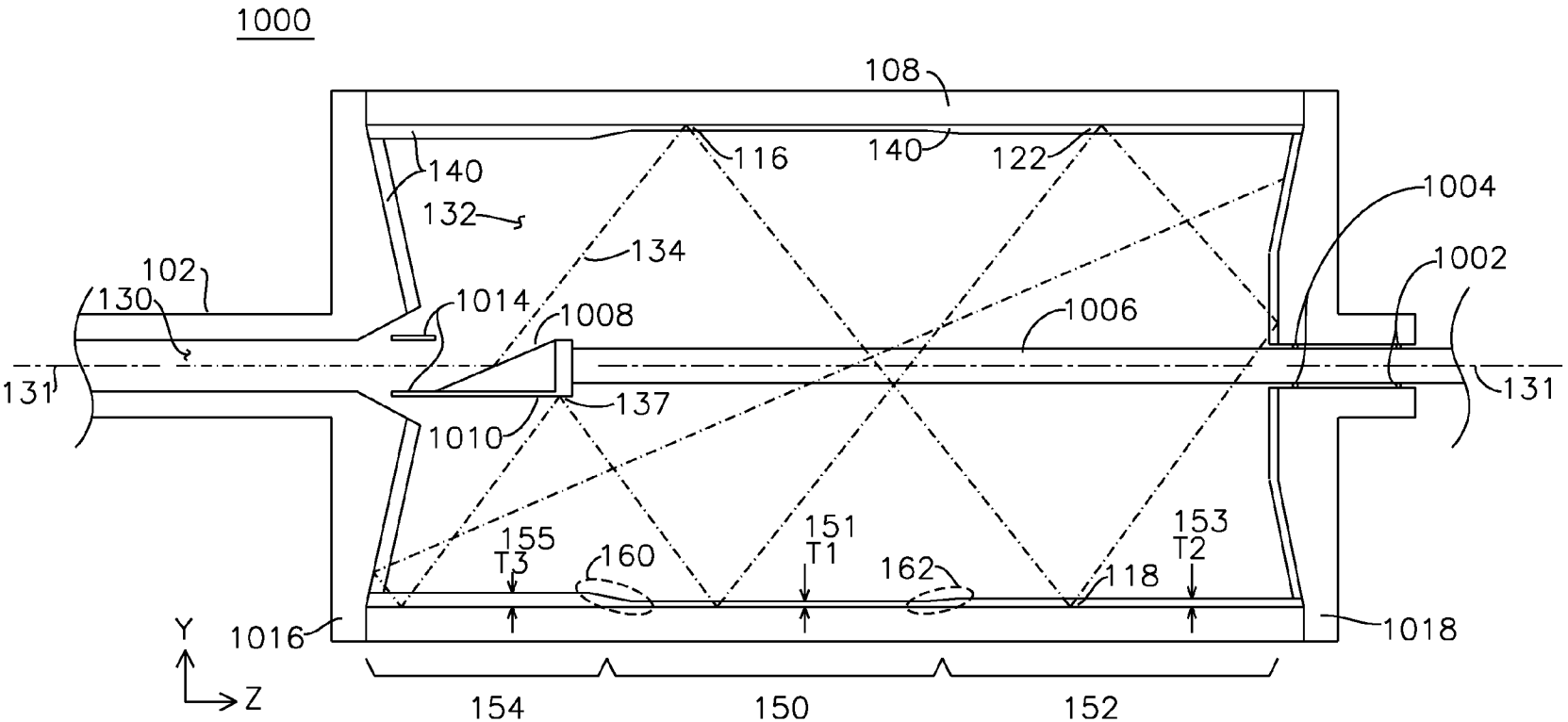
FIG. 10 shows a cross section view of a rear driven low reflection RF load with a rear rotary seal.

Another embodiment of the load 1000 is shown in FIG. 10, which has certain cost advantages when the input waveguide and load is evacuated to reduce plasma arcing from high electric fields inside the waveguide and load.

Vacuum isolation of the load 100 of FIG. 1 requires rotary seals 107, which are present in the form of two separate seals on the two opposing surfaces of the rotary waveguide 106. As rotary vacuum seals are expensive and potential failure points, a variation of the load of figure 1 is shown in FIG. 10 with a drive shaft 1006 at the rear of the load through second end plate 1018 with a single rotary vacuum seal 1004 and rotary bearing 1002 which are both located in a region of the device with optionally lower standing RF energy compared to their location at the RF input in FIG. 1. The use of a single vacuum seal 1004 as shown in FIG. 10 results in a reflection geometry which produces internal reflections of the RF from the drive shaft 1006, which shaft 1006 can be designed with an RF reflective surface, or including a water cooled jacket (not shown) which is contiguous to reflector 1008, and the shaft 1006 may have a partially RF absorptive surface. The other structures of the load 1000 are generally similar to the previously described FIG. 1 load, with the drive shaft 1006 coupled axially to reflector 1008, where reflector 1008 has attached a co-rotating input waveguide 1014 formed from the reflector 1008 and separated from the RF 130 of stationary waveguide 102 which input waveguide 102 may be formed from the first end cap 1016. As before, reflector 1008 has a back surface 1010 and a reflection geometry selected where multi-path reflections are directed to prevent coupling of reflected RF energy back to the input waveguide 102 of the device.

FIG. 11 shows a cross section view of another embodiment of the invention which requires no rotary seals as were required at the input waveguide and first end cap 158 of FIG. 1 or the second end cap 1018 of FIG. 10. As for the previous embodiments, the inner volume 132 is formed from cylindrical body 108, first end cap 1016, and second end cap 1118, which is sealed to a cylindrical support 1106 which is attached to a movable bellows 1102, the opposite end of which is sealed to an undulating reflector 1110, which is shown as conical, but may be any shape which distributes input energy from waveguide 139 onto the dissipation surface 140 as was described previously. The end cap 1118, cylindrical support 1106, bellows 1102, and undulating reflector 1110 provide a vacuum-tight separation from the outer environment surrounding inner volume 132 without the use of rotary seals 1107 of FIG. 1 or 1004 of FIG. 10. In one embodiment of the invention, an inner rotating shaft 1112 is centered about axis 131 and is coupled to a drive mechanism 1114 such as a gear or pulley, and the opposite end of the rotating shaft 1112 enters bellows 1102 where it has an off-axis bend 1104 and is coupled to undulating reflector 1110 with a rotational bearing 1108. The undulating reflector 1110 moves in a manner which describes a circular trajectory about central axis 131, but without axial rotation of the reflector 1110 or bellows 1102. FIG. 12A shows the cross section view A-A of FIG. 11, and shows an off-axis 131 section 1204 of tip 1110 which has movement path 1202 which defines a circle about central axis 131. FIG. 12B shows a cross section view B-B of FIG. 11, through the stationary outer shaft 1106 and rotating inner shaft 1112. The other references and structures of FIG. 11 are as previously described for FIGS. 1 and 10, and are included for reference to these structures.

FIG. 13 shows another embodiment of a low-reflectance RF load similar to FIG. 11, but with a ball joint 1308 coupled to the shaft 1306 and 1304, where the reflector 1302 travels in a circular motion shown in FIG. 13A trajectory 1301 about central axis 131, and the shaft 1306 may be driven as shown in FIG. 13B about central axis 131 in trajectory 1310. In this example embodiment, a flat vacuum bellows 1310 seals the shaft 1304 to the second end cap 1318 to provide a non-rotary sealing surface. Reflector 1302 may be conical, or any surface pattern which directs reflections away from the input waveguide on subsequent multi-path reflections, as was discussed previously. Rear surface 1312 may provide the baffling function to reflect subsequent reflections away from the input waveguide, thereby providing a low-input reflectance RF load.

Many other embodiments of the load are possible, and the example given is for illustration only to understand a few variations of the invention, and the examples are not intended to limit the scope of the invention as set forth in the claims. The low reflectance load is suitable for a wide range of frequencies, including those in the range 70 Ghz to 200 Ghz, a frequency range known as millimeter-wave RF. In one example embodiment of the invention tested by the inventors and shown in FIG. 1, the length of the cylindrical extent encompassing the final reflection extent, primary reflection extent, and secondary reflection extent is on the order of 100 cm, and the diameter of the cylindrical body is on the order of 50 cm, the input waveguide is 10 cm carrying 2MW continuous wave HE11 mode microwave energy at 170 Ghz.

In another example embodiment of the invention, the rotational waveguide joint 106 of FIG. 1 includes a vacuum seal 107 attached to first end cap 158 and stationary input waveguide 102 which provides a stationary coupling surface for the input waveguide associated with the microwave source.

We claim:

1. A load for traveling waves, the load having:

an input waveguide for RF and having a stationary part and a rotating part, said rotating part coupled to a reflector, said reflector having a front surface for coupling to RF in said input waveguide and a back surface which shields impinging RF from coupling to said input waveguide;

an inner volume formed by a first end cap, a second end cap, and a cylindrical body therebetween, said first end cap having an aperture for said input waveguide and said reflector;

said inner volume first end cap and an adjacent extent of said cylindrical body having an absorptive coating and forming a terminal reflection surface, said inner volume second end cap and an adjacent extent of said cylindrical body forming a secondary reflection surface, said cylindrical body secondary reflective surface having an absorptive coating, and an extent between said terminal reflection surface and said secondary reflection surface forming a primary reflection surface;

whereby RF coupled to said input waveguide is reflected from said rotating reflector to said primary reflection surface, thereafter to said secondary reflection surface, and thereafter to said terminal reflection surface and onto said rotating reflector back surface;

and where a reflection loss of said primary reflection surface absorptive coating is less than a reflection loss of said secondary reflection surface absorptive coating.

2. The load of claim 1 where said coating is at least one of black rutile or carbon.

3. The load of claim 1 where said rotating reflector front surface has a convex surface shape in at least one of an axial cross section or a lateral cross section.

4. The load of claim 1 where a coating thickness of said terminal reflection surface is greater than a coating thickness of said secondary reflection surface and said coating thickness of said secondary reflection surface is greater than a coating thickness of said primary reflection surface.

5. The load of claim 1 where said input waveguide is corrugated and said RF is HE11 mode microwave RF energy.

6. The load of claim 1 where said reflector, said first end cap, and said second end cap have internal reflection angles which result in the multi-path reflection of applied RF energy to the back surface of said reflector.

7. A low reflectance load having:

an input waveguide for traveling waves, said input waveguide traveling waves coupled to a reflector front surface, said reflector having a rear surface which shields impinging waves from coupling to said input waveguide;

a cylindrical energy dissipation cavity having a central axis and formed from the inner surfaces of a first end cap, a second end cap, and a cylindrical wall, said first end cap having an aperture coupled to said input waveguide and said reflector;

where traveling waves from said input waveguide reflect from said reflector front surface, subsequently reflect from a primary reflection surface formed by said cylindrical wall, thereafter reflect from a secondary reflection surface formed by said second end cap and a surface of said cylindrical wall adjacent to said second end cap, and thereafter reflect from a terminal reflection surface formed by said first end cap and a surface of said cylindrical wall adjacent to said first end cap, said terminal reflection surface also including said reflector rear surface;

said primary reflection surface having a lower reflection absorption than said secondary reflection surface, said secondary reflection surface having a lower reflection absorption than said terminal reflection surface.

8. The low reflectance load of claim 7 where said terminal reflection surface is an absorptive coating which is thicker than said secondary reflection surface absorptive coating, and said secondary reflection surface absorptive coating is thicker than said primary reflection surface absorptive coating.

9. The low reflectance load of claim 7 where said reflective surface is coated with at least one of black rutile or carbon.

10. The low reflectance load of claim 7 where said reflector rotates about said central axis with respect to said cylindrical wall, said first end cap, or said second end cap.

11. The low reflectance load of claim 7 where said reflector front surface has a convex shape.

12. The low reflectance load of claim 7 where said reflector front surface shape causes a substantially uniform beam profile to be reflected onto said primary reflection surface.

13. The low reflectance load of claim 7 where said input waveguide includes a stationary part and a rotating part coupled to said reflector, said stationary part and said rotating part coupled with a rotary joint.

14. The low reflectance load of claim 7 where said rotating reflector is coupled to a rotating shaft passing through said second end cap and includes a vacuum seal between said second end cap and said rotating shaft.

15. The low reflectance load of claim 7 where said rotating reflector is conical and the rotation of said conical reflector is accomplished by moving a shaft coupled to said conical reflector and passing through said second end cap in a circumferential motion where said shaft does not rotate with respect to said axis, but moves in a circular motion, thereby causing the tip of said conical reflector to move in a substantially circular movement with respect to the central axis of said cylindrical region.

16. The low reflectance load of claim 7 where said rotating reflector is a conical reflector which is driven to cause a tip of the conical reflector to move in a substantially circular direction about the cylindrical body axis, and said conical reflector does not rotate with respect to said cylindrical body axis.

17. The low reflectance load of claim 7 where said attenuative metal is stainless steel.

18. The low reflectance load of claim 7 where only said first end cap and said cylindrical wall have said absorptive coating.

* * * * *